US010520294B1

(12) United States Patent
Connolly et al.

(10) Patent No.: US 10,520,294 B1
(45) Date of Patent: Dec. 31, 2019

(54) AMMUNITION PACKAGING

(71) Applicant: Tac-Pac, LLC, Boise, ID (US)

(72) Inventors: Andrew B. Connolly, Boise, ID (US); Dennis M. Van Acker, Meridian, ID (US); David Fallon, Eagle, ID (US)

(73) Assignee: Tac-Pac, L.L.C., Boise, ID (US)

( * ) Notice: Subject to any disclaimer, the term of this patent is extended or adjusted under 35 U.S.C. 154(b) by 0 days.

(21) Appl. No.: 16/050,132

(22) Filed: Jul. 31, 2018

(51) Int. Cl.
*B65D 85/20* (2006.01)
*F42B 39/26* (2006.01)
*B65D 71/70* (2006.01)

(52) U.S. Cl.
CPC ..... *F42B 39/26* (2013.01); *B65D 71/70* (2013.01); *B65D 85/20* (2013.01)

(58) Field of Classification Search
USPC ..... 206/3, 748, 749, 745; 220/4.26, 4.27, 6
See application file for complete search history.

(56) References Cited

U.S. PATENT DOCUMENTS 2,877,891 A * 3/1959 Chartrand ..... F42B 39/02 206/3
4,951,812 A * 8/1990 Chen ..... B25H 3/023 190/16
4,998,616 A * 3/1991 Hillinger ..... A45C 7/0054 190/17
5,145,064 A * 9/1992 Chen ..... B25H 3/023 206/372
5,772,110 A * 6/1998 Garretson ..... B65D 5/009 206/749
6,772,896 B1 * 8/2004 Dobbin ..... A61F 17/00 220/4.27
8,079,465 B2 * 12/2011 Edwards ..... F42B 39/26 206/3
8,631,943 B2 * 1/2014 Kobbe ..... B65D 75/225 206/15.2
9,038,817 B2 * 5/2015 Connolly ..... B65B 5/08 206/3
2009/0145791 A1 * 6/2009 Panosian ..... B25H 3/003 206/379
2011/0284532 A1 * 11/2011 Naik ..... B65D 75/327 220/6
2015/0096907 A1 * 4/2015 Connolly ..... F42B 39/26 206/3

* cited by examiner

*Primary Examiner* — Jacob K Ackun
(74) *Attorney, Agent, or Firm* — Hawley Troxell Ennis & Hawley LLP; Philip McKay

(57) ABSTRACT

An ammunition package includes a three panel single piece tri-fold container which folds from an open configuration to a closed configuration via hinges provided for the purpose. The ammunition package further includes a cartridge stabilization plate. Ammunition cartridges stored within the container lie flat, e.g. roughly parallel with respect to the base or bottom of the package. Converting between the open configuration and the closed configuration takes place by folding or unfolding the left and right panels at the hinges with respect to the center panel.

6 Claims, 5 Drawing Sheets

AMMUNITION PACKAGING

BACKGROUND

Ammunition for small arms including handguns and rifles has, for at least a century, been packaged for sale to the consumer in cardboard or pressed paper containers. Individual rounds have commonly been placed in matrices formed of pressed paper or cardboard, and more recently a polystyrene foam or other drillable or otherwise formable substrate.

These cardboard or pressed paper containers are found lacking in a number of areas. For example, if the packaging is subjected to moisture, the structure of the cardboard and pressed paper containers is often compromised and decomposition of the containers is accelerated. While a goal might be to store ammunition in dry environments, it is not uncommon for ammunition and its packaging to be subjected to extreme environmental conditions including moisture, leading to possible corrosion and other negative effects.

Similarly, the highly decomposable pressed paper or cardboard containers are not very robust and deteriorate rapidly and thus have a minimal probability of surviving for reuse. Additionally, cardboard and pressed paper boxes box have a diminishing appeal for display purposes particularly in light of developments in recyclable plastics.

Additionally, paper-based packaging provides a minimum level of security for the product while on the shelf. While a rectangular pressed paper box provides a convenient configuration for stacking and storage, the benefits of traditional packaging end there. As with any product, consumers are eager to see the actual product being purchased. With a paper product carton or box, the consumer must open the container in order to see the product. Paper product cartons and boxes are prone to being left open after inspection of the product by the consumer, thus leaving the product inside the carton or box open to theft, deterioration, loss or other undesirable effects. Additionally, traditional paper product carton packaging for ammunition has traditionally served the sole purpose of containing cartridges without consideration for providing container configurations that may be employed for containing other materials, for instance spent brass, manufacturer literature, advertisements, coupons or the like.

For any or all of the reasons above, therefore, it would be beneficial to provide ammunition packaging that increases durability, resistance to moisture and security for the product while on the shelf as well as increased visibility of the product.

SUMMARY OF THE INVENTION

Embodiments of the inventions described herein are directed to ammunition packages. In one embodiment, an ammunition package includes a tri-fold container formed of a single piece, the tri-fold container including a right-side panel, a left-side panel and a center panel, the right-side panel and the left-side panels being attached through respective hinges to opposite sides of the center panel and configured so that when the ammunition package is in an open configuration the left-side panel has a top side and a bottom side, and the right-side panel has a top side and a bottom side, and in a closed configuration the top side of the left side panel faces towards a bottom of the center panel and the top side of the right side panel also faces towards the bottom of the center panel. Converting between the open configuration and the closed configuration takes place by folding or unfolding the left and right panels at the hinges with respect to the center panel.

In one embodiment, the tri-fold container is configured to store ammunition cartridges horizontally oriented so that the ammunition cartridges are relatively parallel to the bottom of the center panel. Thus, when the ammunition package is lying flat on a table, ammunition cartridges stored therein are relatively horizontally oriented with respect to the table. In one embodiment, ammunition cartridges stored therein are oriented so that an angle of line formed between a center of a first end of the ammunition cartridge and a center of a second end of the ammunition cartridge and a bottom surface of the center panel is less than an angle formed between the center of the first end of the ammunition cartridge and the center of the second end of the ammunition cartridge and a line perpendicular to the bottom surface of the center panel. In one embodiment, ammunition cartridges stored therein are oriented so that an angle of line formed between a center of a first end of the ammunition cartridge and a center of a second end of the ammunition cartridge and a bottom surface of the center panel is less than 45 degrees. In one embodiment, ammunition cartridges stored therein are oriented so that an angle of line formed between a center of a first end of the ammunition cartridge and a center of a second end of the ammunition cartridge and a bottom surface of the center panel is less than 20 degrees.

In one embodiment, the center panel has a bottom panel and one or more side panels, the bottom panel including a plurality of cartridge receiving areas, each of the plurality of cartridge receiving areas having a longitudinal orientation configured to receive and store at least one ammunition cartridge. In one embodiment, ammunition cartridges stored within the ammunition package do not come into contact with each other, even when those ammunition cartridges are stored in adjacent cartridge receiving areas, e.g. right next to each other, right above and below each other, etc.

In one embodiment, the ammunition package further includes a cartridge stabilization plate configured to be inserted into the center panel prior to converting the tri-fold container from an open configuration into a closed configuration, the cartridge stabilization plate having a plurality of cartridge receiving areas. In one embodiment, cartridge stabilization plate is able to be installed within ammunition package right-side up, or upside down, in order to accommodate different diameters of ammunition cartridges. Therefore, the ammunition package discussed herein is able to accommodate multiple calibers of ammunition, whereas packages in the prior art are typically only able to accommodate or store only a single caliber of ammunition.

In one embodiment, the cartridge stabilization plate cartridge receiving areas each have a longitudinal axis configured to receive and store at least one ammunition cartridge. Thus, when the ammunition package is lying flat on a table, ammunition cartridges stored above or below the cartridge stabilization plate with respect to the table are relatively horizontally oriented with respect to the table. In one embodiment, ammunition cartridges stored on the cartridge stabilization plate are oriented so that an angle of line formed between a center of a first end of the ammunition cartridge and a center of a second end of the ammunition cartridge and a top surface of the cartridge stabilization plate is less than an angle formed between the center of the first end of the ammunition cartridge and the center of the second end of the ammunition cartridge and a line perpendicular to the top surface of the cartridge stabilization plate. In one embodiment, ammunition cartridges stored on the top surface of the cartridge stabilization plate are oriented so that an angle of line formed between a center of a first end of the ammunition cartridge and a center of a second end of the ammunition cartridge and a top surface of the cartridge stabilization plate is less than 45 degrees. In one embodiment, ammunition cartridges stored on the top surface of the cartridge stabilization plate are oriented so that an angle of line formed between a center of a first end of the ammunition cartridge and a center of a second end of the ammunition cartridge and a top surface of the cartridge stabilization plate is less than 20 degrees.

In one embodiment, the cartridge stabilization plate is configured to be held in position against a first land by a plurality of retainers, the cartridge stabilization plate having a first side and a second side, the first and second sides each having extrusions configured to stabilize ammunition cartridges horizontally stored within the ammunition package.

In one embodiment, the ammunition package is rectangular and has a first side, a second side, a third side and a fourth side, where the first side and the second side are each longer than the third side and the fourth side.

In one embodiment, the ammunition package is configured to store ammunition cartridges where a longitudinal axis of the ammunition cartridges is oriented generally parallel, e.g. within 25 degrees of being parallel, to the bottom of the center panel.

In one embodiment, the ammunition package is configured to store ammunition cartridges where a longitudinal axis of the ammunition cartridges is oriented generally parallel to the bottom of the center panel. Thus, ammunition cartridges are positioned generally parallel to and in a horizontal orientation with respect to the bottom of the center panel when the ammunition container is in a closed configuration.

In one embodiment, the cartridge stabilization plate includes extrusions, otherwise referred to as support surfaces, on a top side and an opposite or bottom side where each extrusion of the cartridge stabilization plate has a right side and a left side, with at least one or either the right side or the left side of at least one extrusion having a radius designed to meet with a radius of an ammunition cartridge stored within the ammunition package.

In one embodiment, the right panel of the ammunition package includes one or more extrusions projecting from a top side of the right panel and configured to stabilize one or more ammunition rounds when stored within the ammunition package.

In one embodiment, when the ammunition package is in a closed configuration, the right panel is folded into a position with a friction fitting with the center panel and the left panel is then folded into a position with a friction fitting with the right panel.

In one embodiment, with the ammunition package in a closed configuration, and with ammunition cartridges stored within the ammunition package, ammunition cartridges that are adjacent to one or more other ammunition cartridges stored within the ammunition package are not in contact with each other. Thus, in one embodiment, the ammunition package is constructed so that no ammunition cartridge properly stored within the ammunition package is in contact with any other ammunition cartridge. This is primarily achieved by the location and size of support surfaces, e.g. extrusions.

In one embodiment, when the ammunition package is in a closed configuration, positions of extrusions of the bottom of the center panel are offset with respect to positions of extrusions of the right panel.

In one embodiment, when the ammunition package is in a closed configuration, positions of extrusions of the bottom of the center panel are matched with extrusions of the right panel.

In one embodiment, in a first configuration of the cartridge stabilization plate, extrusions of a first side of the cartridge stabilization plate map to extrusions of the bottom of the center panel and extrusions of a second side of the cartridge stabilization plate map to extrusions of the top side of the right panel.

In one embodiment, in a second configuration of the cartridge stabilization plate, extrusions of a first side of the cartridge stabilization plate are offset with respect to extrusions of the bottom of the center panel and extrusions of a second side of the cartridge stabilization plate are offset with respect to extrusions of the top side of the right panel.

In one embodiment, when the ammunition package is in a closed configuration, a cutout portion of an edge of the center panel maps to a roughened portion of an edge of the right panel to assist in converting the closed configuration to an open configuration.

In one embodiment, an outside surface of the bottom of the center panel of a first ammunition package includes two or more extrusions configured to map into a top surface of a second ammunition package formed into a stacked configuration with the first ammunition package.

In one embodiment, the top side of the right-side panel includes one or more extrusions projecting from a base of the top side into the interior of the ammunition container when the ammunition container is in a closed configuration, the extrusions configured to stabilize one or more ammunition rounds stored within the ammunition package.

DETAILED DESCRIPTION

Figure 1:
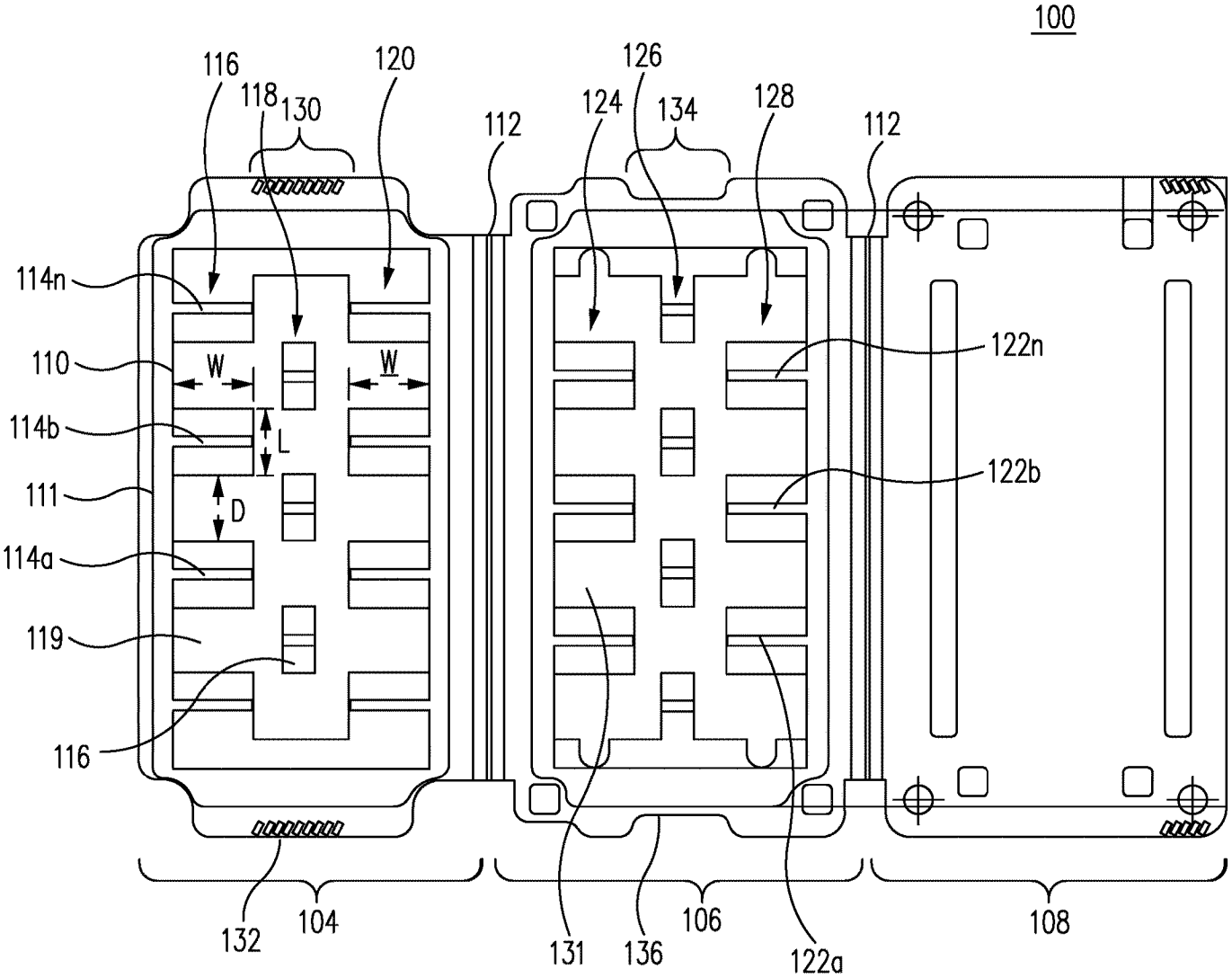
FIGS. 1 and 2 are a representative overhead and isometric views of a tri-fold container of an ammunition package in an open configuration according to one embodiment.
Figure 2:
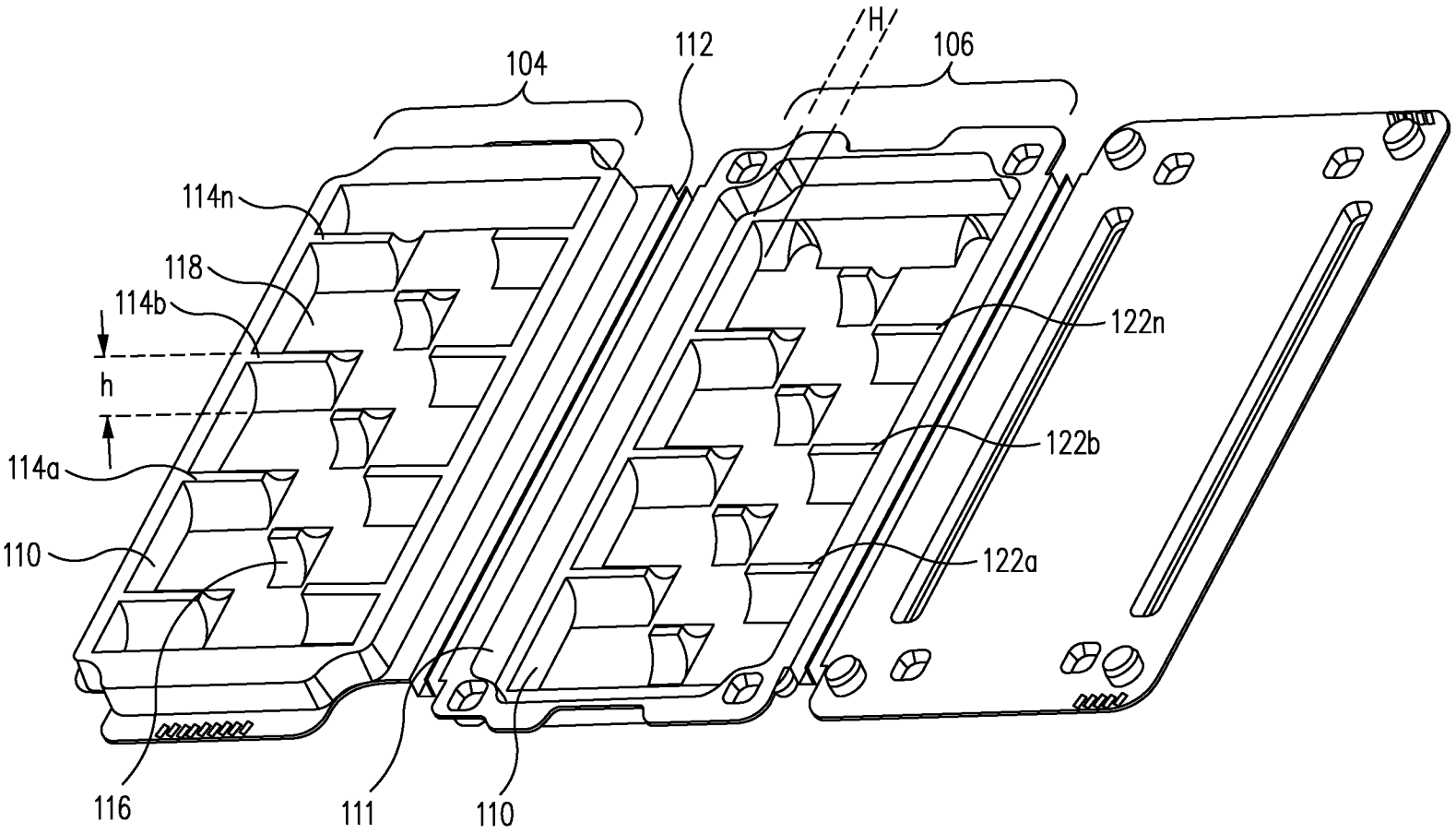

FIGS. 1 and 2 represent two different views of a tri-fold container 100 of an ammunition package 300 (of FIG. 3) including left panel 104, center panel 106 and right panel 108. At least left panel 104 and center panel 106 each have side panels 110 and thus each of left panel 104 and center panel 106 have a depth equivalent to the respective heights of the respective side panels 110. The respective depths of side panel 110 for left panel 104 and side panel 110 for center panel 106 may be the same, or might be different, depending on a particular design of a product implementing the subject matter of this disclosure. Additional side panels 111 are also present, in one embodiment, to provide space for left panel 104 and right panel 108 to fold into center panel 106 when converting ammunition package 300 from an open configuration such as seen in FIGS. 1 and 2 into a closed configuration such as seen in FIG. 3.

To complete assembly of an ammunition package 300 disclosed herein, tri-fold container 100 is combined with a cartridge stabilization plate 400 of FIG. 4, according to one embodiment. In one embodiment, ammunition package 300 is formed of a thermoplastic, such as polyethylene terephthalate (PET). In one embodiment, at least part of ammunition package 300 is transparent.

Figure 3:
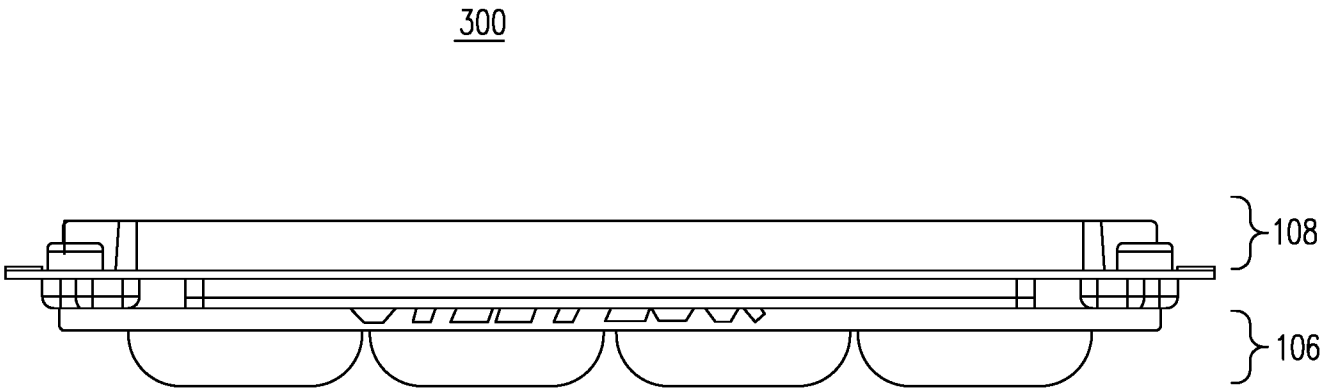
FIG. 3 is a representative side view of an ammunition package in a closed configuration according to one embodiment.

Returning to FIGS. 1 and 2, tri-fold container 100 includes hinges 112 between left panel 104 and center panel 106 as well as between center panel 106 and right panel 108, where hinges 112 serve to provide pivot points for the respective left panel 104 and right panel 108 to fold into center panel 106 when converting tri-fold container 100 from an open configuration, such as the configuration displayed in FIGS. 1 and 2 into a closed configuration, such as the configuration displayed in FIG. 3. To be clear, when ammunition package 300 is in a fully open configuration left panel 104 has a top side (facing upwards or towards the viewer in FIGS. 1 and 2) and a bottom side (facing downwards or away from the viewer in FIGS. 1 and 2), and right panel 108 has a top side (facing upwards or towards the viewer in FIGS. 1 and 2) and a bottom side (facing downwards or away from the viewer in FIGS. 1 and 2), and in a closed configuration the top side of left panel 104 faces towards a bottom of the center panel (downward, in FIGS. 1 and 2) and the top side of right side panel 108 also faces towards the bottom of center panel 106. Converting between the open configuration and the closed configuration takes place by folding or unfolding the left panel 104 and right panel 108 into center panel 106.

Continuing to refer to FIGS. 1 and 2, in one embodiment, some number of one or more support surfaces 114*a*, 114*b*, and 114*n*, with the reference "n" being used to indicate that a variable number of support surfaces employed in a given implementation may differ from other implementations, are provided which are configured to provide support to ammunition cartridges stored within ammunition package 300.

In one embodiment, one or more of support surfaces 114*a*, 114*b*, and 114*n* are injection molded as permanent inseparable components of left panel 104. In one embodiment, the height of support surfaces 114*a*, 114*b*, and 114*n* is greater than one-half of the largest diameter of an ammunition cartridge ammunition package 300 is designed to store. In one embodiment, opposite sides of support surfaces 114*a*, 114*b*, and 114*n* are concavely curved to configure support surfaces 114*a*, 114*b*, and 114*n* to support the convex curvature of ammunition cartridges being stored within ammunition package 300. In one embodiment, curved opposite sides of support surfaces 114*a*, 114*b*, and 114*n* and have a curvature having a radius equal to or greater than a radius of a shell component, commonly made of brass, of an ammunition cartridge ammunition package 300 is designed to store. In one embodiment, support surfaces 114*a*, 114*b*, and 114*n* have a width and a length, both measured at a base of support surfaces 114*a*, 114*b*, and 114*n* where support surfaces 114*a*, 114*b*, and 114*n* extrude from the top side of left panel 104. Left panel 104 of FIG. 1 shows three columns of support surfaces 114*a*, 114*b*, and 114*n*, a left-side column 116, and middle column 118, and a right-side column 120. Fewer, or more, columns may be present in a given implementation of the inventions discussed herein, depending on a wide variety of factors controlled by the designer of a particular implementation. In one embodiment, support surfaces 114*a*, 114*b*, and 114*n* have a rectangular foot print at a base of each of support surfaces 114*a*, 114*b*, and 114*n* where support surfaces 114*a*, 114*b*, and 114*n* extrude from the top side of left panel 104. In one embodiment, a width W of each support surface 114*a*, 114*b*, and 114*n* is greater than a length L of support surfaces 114*a*, 114*b*, and 114*n* when viewed in a flat, or open configuration such as that seen in FIGS. 1 and 2.

In one embodiment, width W of left-side column 116 of support surfaces 114*a*, 114*b*, and 114*n* and the width W of right-side column 120 of support surfaces 114*a*, 114*b*, and 114*n* are equal. In one embodiment, a second column of support surfaces, such as support surfaces 116, is disposed between the first and third columns of support surfaces 114*a*, 114*b*, and 114*n*, and each individual support surface of column 116 is disposed at a row position where spaces 119 between support surfaces 114*a*, 114*b*, and 114*n* are present.

For example, consider table 1 below, representing a layout configuration of left-panel 104 of FIG. 1:

TABLE 1

| Left-most Column | Center Column | Right-most Column |
|---|---|---|
| 114n | space | Support surface |
| space | Support surface | space |
| 114b | space | Support surface |
| space | Support surface | space |
| 114a | space | Support surface |
| Space | Support surface | space |
| Support surface | space | Support surface |

In one embodiment, support surfaces 114*a*, 114*b*, and 114*n* are disposed in the left-most column 116 with spaces between them. Correspondingly, additional support surfaces in the third, or right-most column 120 of table 1 are disposed at positions within the column similar to where support surfaces 114*a*, 114*b*, and 114*n* were disposed in first, or left-most column 116.

Further, in a second, or center column 118, support surfaces are disposed next to spaces of the left-most column 116 and right-most column 120, and spaces of the center column 118 are positioned at locations between support surfaces of the left-most and right-most columns, according to one embodiment.

In one embodiment, a length of support surfaces 114*a*, 114*b*, and 114*n* and a distance between each of support surfaces 114*a*, 114*b*, and 114*n* are equal. In one embodiment, space 119 between two consecutive support surfaces 114*a*, 114*b*, and 114*n* is greater than a diameter of an ammunition cartridge that ammunition package 300 is designed to store.

In one embodiment, a number of rows of support surfaces 114*a*, 114*b*, and 114*n* of a given column varies depending on the overall size of ammunition package 300.

Like support surfaces of left-most column 116 of left panel 104, the height of support surfaces of center column 118 and right-most column 120 of left panel 104 is greater than one-half of the largest diameter of an ammunition cartridge ammunition package 300 is designed to store. In one embodiment, opposite sides of those support surfaces are concavely curved to configure those support surfaces to support the convex curvature of ammunition cartridges being stored within ammunition package 300. In one embodiment, curved opposite sides of those support surfaces and have a curvature having a radius equal to or greater than a radius of a shell component, commonly formed of brass, of an ammunition cartridge ammunition package 300 is designed to store.

In one embodiment, just like support surfaces 114*a*, 114*b*, and 114*n*, support surfaces of center column 118 and the right-most column 120 of left panel 104 have widths and lengths, both measured at a base of those respective support surfaces where those support surfaces extrude from the top side of left panel 104. In one embodiment, with respect to the right-most column 120 of left panel 104, a width W of each support surface of the right-most column is greater than a length L of the support surface when viewed in a flat, or open configuration such as that seen in FIGS. 1 and 2. In one embodiment, with respect to the center column 118 of left panel 104, a width W of each support surface is less than or equal to a length L of the same support surface when viewed in a flat, or open configuration such as that seen in FIGS. 1 and 2.

In one embodiment, width W of left-side column 116 of support surfaces 114*a*, 114*b*, and 114*n* and the width W of right-side column 120 of support surfaces 114*a*, 114*b*, and 114*n* are equal. In one embodiment, a second column of support surfaces, such as second column 118, is disposed between the first and third columns of support surfaces 114*a*, 114*b*, and 114*n*, and each individual support surface of column 116 is disposed at a row position where spaces 119 between support surfaces 114*a*, 114*b*, and 114*n* are present. In one embodiment, distances between support surfaces, such as support surfaces 114*a*, 114*b*, and 114*n* is dependent on the caliber, and therefore the diameter of ammunition cartridges ammunition package 300 is designed to store.

The following generally applies to center panel 106. Much of the same information provided herein for left panel 104 applies to center panel 106. In one embodiment, however, if the top left position of left panel 104 is a support surface, then the top left position of center panel 106 is a space, as seen in FIG. 1. In one embodiment, however, if the top left position of left panel 104 is a space, then the top left position of center panel 106 is a support surface, as seen in FIG. 1. All other spaces and support surfaces will be determined alternatingly, from there on. Correspondingly, the positions of spaces and support surfaces of center panel 106 alternate, as they did with left panel 104, according to one embodiment.

In one embodiment, one or more of support surfaces 122*a*, 122*b*, and 122*n* of center panel 106 are injection molded as permanent inseparable components of center panel 106. In one embodiment, the height of support surfaces 122*a*, 122*b*, and 122*n* is greater than one-half of the largest diameter of an ammunition cartridge ammunition package 300 is designed to store. In one embodiment, opposite sides of support surfaces 122*a*, 122*b*, and 122*n* are concavely curved to configure support surfaces 122*a*, 122*b*, and 122*n* to support the convex curvature of ammunition cartridges being stored within ammunition package 300. In one embodiment, curved opposite sides of support surfaces 122*a*, 122*b*, and 122*n* and have a curvature having a radius equal to or greater than a radius of a brass shell component of an ammunition cartridge ammunition package 300 is designed to store. In one embodiment, support surfaces 122*a*, 122*b*, and 122*n* have a width and a length, both measured at a base of support surfaces 122*a*, 122*b*, and 122*n* where support surfaces 122*a*, 122*b*, and 122*n* extrude from the bottom, or base, of center panel 106. Center panel 106 of FIGS. 1 and 2 shows three columns of support surfaces, a left-side column 124, and middle column 126, and a right-side column 128. Fewer, or more, columns may be present in a given implementation of the inventions discussed herein, depending on a wide variety of factors controlled by the designer of a particular implementation. In one embodiment, support surfaces 122*a*, 122*b*, and 122*n* have a rectangular foot print at a base of each of support surfaces 122*a*, 122*b*, and 122*n* where support surfaces 122*a*, 122*b*, and 122*n* extrude from the top side of left panel 104. In one embodiment, a width W of support surfaces 122*a*, 122*b*, and 122*n* is greater than a length L of support surfaces 122*a*, 122*b*, and 122*n* when viewed in a flat, or open configuration such as that seen in FIGS. 1 and 2.

In one embodiment, width W of left-side column 124 of support surfaces 122*a*, 122*b*, and 122*n* and the width W of right-side column 128 of support surfaces 122*a*, 122*b*, and 122*n* are equal. In one embodiment, second column 126 of support surfaces, such as support surfaces 116, is disposed between the first and third columns of support surfaces 122*a*, 122*b*, and 122*n*, and each individual support surface of column 126 is disposed at a row position where spaces 119 between support surfaces 122*a*, 122*b*, and 122*n* are present.

For example, consider Table 2 below, representing a layout configuration of center panel 106 of FIG. 2:

TABLE 2

| Left-most Column | Center Column | Right-most Column |
|---|---|---|
| space | support surface | space |
| support surface | space | 122n |
| space | support surface | space |
| support surface | space | 122b |
| space | support surface | space |
| support surface | space | 122a |
| space | support surface | space |

In one embodiment, support surfaces 122*a*, 122*b*, and 122*n* are disposed in the left-most column 124 with spaces between them in the same column. Correspondingly, additional support surfaces in the third, or right-most column 128 of table 2 are disposed at positions within the column similar to where support surfaces 122*a*, 122*b*, and 122*n* were disposed in first, or left-most column 124.

Further, in a second, or center column 126, support surfaces are disposed next to spaces of the left-most column 124 and right-most column 128, and spaces of the center column 126 are positioned at locations between support surfaces of the left-most column 124 and right-most column 128, according to one embodiment.

In one embodiment, a length of support surfaces 122*a*, 122*b*, and 122*n* and a distance between each of support surfaces 122*a*, 122*b*, and 122*n* are equal. In one embodiment, the space 131 between two consecutive support surfaces 122*a*, 122*b*, and 122*n* is greater than a diameter of an ammunition cartridge that ammunition package 300 is designed to store.

In one embodiment, a number of rows of support surfaces 122*a*, 122*b*, and 122*n* of a given column varies depending on the overall size of ammunition package 300.

Like support surfaces of left-most column 116 of left panel 104, the height of support surfaces of center column 126 and right-most column 128 of center panel 106 is greater than one-half of the largest diameter of an ammunition cartridge ammunition package 300 is designed to store. In one embodiment, opposite sides of those support surfaces are concavely curved to configure those support surfaces to support the convex curvature of ammunition cartridges being stored within ammunition package 300. In one embodiment, curved opposite sides of those support surfaces and have a curvature having a radius equal to or greater than a radius of a brass shell component of an ammunition cartridge ammunition package 300 is designed to store.

In one embodiment, just like support surfaces 122*a*, 122*b*, and 122*n*, support surfaces of center column 126 and the right-most column 128 of center panel 106 have widths and lengths, both measured at a base of those respective support surfaces where those support surfaces extrude from the bottom surface of center panel 106. In one embodiment, with respect to the right-most column 128 of center panel 106, a width W of each support surface of the right-most column is greater than a length L of the support surface when viewed in a flat, or open configuration such as that seen in FIGS. 1 and 2. In one embodiment, with respect to the center column 126 of center panel 106, a width W of each support surface is less than or equal to a length L of the same support surface when viewed in a flat, or open configuration such as that seen in FIGS. 1 and 2.

In one embodiment, width W of left-side column 124 of support surfaces 122*a*, 122*b*, and 122*n* and the width W of right-side column 128 of support surfaces 122*a*, 122*b*, and 122*n* are equal within a predetermined tolerance. In one embodiment, the predetermined tolerance is 10% or less. In one embodiment, a second column of support surfaces, such as second column 126, is disposed between the first column 124 and third column 128 of support surfaces 122*a*, 122*b*, and 122*n*, and each individual support surface of column 126 is disposed at a row position where spaces 131 between support surfaces 122*a*, 122*b*, and 122*n* are present. In one embodiment, distances between support surfaces, such as support surfaces 122*a*, 122*b*, and 122*n* is dependent on the caliber, and therefore the diameter, of ammunition cartridges ammunition package 300 is designed to store.

In one embodiment, left panel 104 includes one or more open-assist areas such as open-assist areas 130 and 132. In one embodiment, open-assist areas 130 and 132 a raised surface area configured to help a user identify and employ open-assist areas 130 and 132 to open ammunition package 300 thus beginning, and possibly completing a conversion of ammunition package 300 from a closed configuration to an open configuration.

In one embodiment, center panel 106 includes one or more cutout areas such as cutout areas 134 and 136 which are positions to overlap one or more open-assist areas 130 and 132 when left panel 104 has been folded along hinge 112 into center panel 106.

Focusing specifically on FIG. 2, a height 'h' of the various support surfaces of left panel 104 and center panel 106 is the same as the height 'H' of side panel 110, according to one embodiment. In one embodiment, a height 'h' of the various support surfaces of left panel 104 and center panel 106 is less than the height 'H' of side panel 110.

FIG. 3 is a representative side view of an ammunition package in a closed configuration according to one embodiment.

Referring to FIG. 3, the closed configuration is achieved from the open configuration of FIGS. 1 and 2 by folding left panel 104 along left-side hinge 112 into center panel 106, and then further by folding right panel 108 along right-side hinge 112 into center panel 106.

Figure 4B:
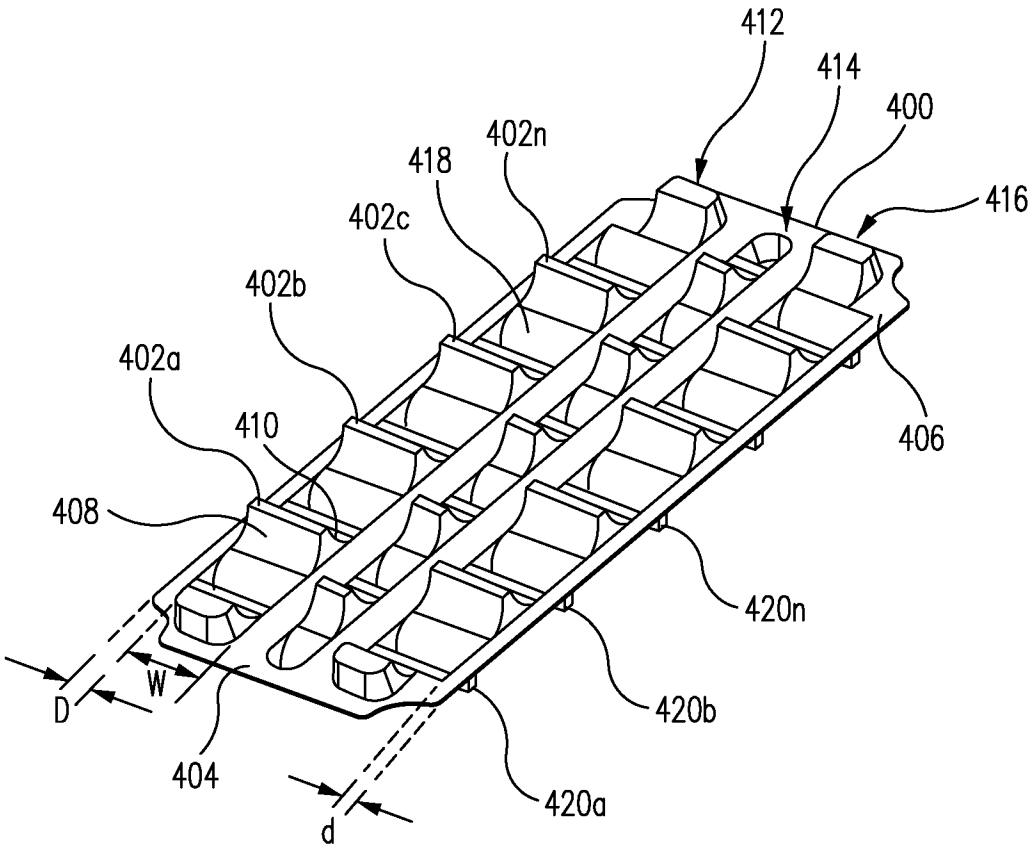
FIGS. 4A and 4B represent overhead and isometric views of a cartridge stabilization plate according to one embodiment.
Figure 4A:
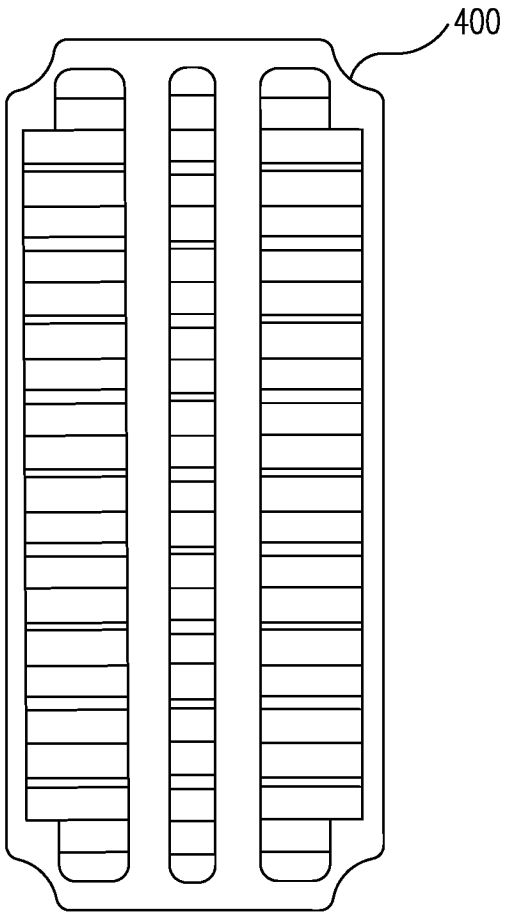

FIGS. 4A and 4B represent overhead and isometric views of a cartridge stabilization plate 400, according to one embodiment.

Similarities exist between portions of left panel 104 and center panel 106 and cartridge stabilization plate 400. Thus, we repeat here some of those similarities, according to various embodiments. For examples, characteristics, placement, construction, implementation and use of support surfaces discussed herein may be duplicated between one or more of left panel 104, center panel 106 and cartridge stabilization plate 400.

In one embodiment, one or more of support surfaces 402*a*, 402*b*, 402*c*, and 402*n* of a first side 404 of cartridge stabilization plate 400 are injection molded as permanent inseparable components of cartridge stabilization plate 400. In one embodiment, the height of support surfaces 402*a*, 402*b*, 402*c*, and 402*n* is greater than one-half of the largest diameter of an ammunition cartridge ammunition package 300 is designed to store. In one embodiment, opposite sides, e.g. sides 408 and 410 of support surface 402*a*, for example, of various support surfaces, such as support surfaces 402*a*, 402*b*, 402*c*, and 402*n* are concavely curved to configure support surfaces 402*a*, 402*b*, 402*c*, and 402*n* to support the convex curvature of ammunition cartridges being stored adjacent to those concavely curved sides within ammunition package 300. In one embodiment, curved opposite sides of support surfaces 402*a*, 402*b*, 402*c*, and 402*n* have a curvature having a radius equal to or greater than a radius of a brass shell component of an ammunition cartridge ammunition package 300 is designed to store. In one embodiment, support surfaces 402*a*, 402*b*, 402*c*, and 402*n* have a width and a length, both measured at a base of support surfaces 402*a*, 402*b*, 402*c*, and 402*n* where support surfaces 402*a*, 402*b*, 402*c*, and 402*n* extrude from the bottom, or base, of cartridge stabilization plate 400. Cartridge stabilization plate 400 of FIG. 4 shows three columns of support surfaces, a left-side column 412, middle column 414, and right-side column 416. Fewer, or more, columns may be present in a given implementation of the inventions discussed herein, depending on a wide variety of factors controlled by the designer of a particular implementation. In one embodiment, support surfaces 402*a*, 402*b*, 402*c*, and 402*n* have a rectangular foot print at a base of each of support surfaces 402*a*, 402*b*, 402*c*, and 402*n* where support surfaces 402*a*, 402*b*, 402*c*, and 402*n* extrude from the first side 404 of cartridge stabilization plate 400. In one embodiment, a width W of support surfaces 402*a*, 402*b*, 402*c*, and 402*n* is greater than a length L of support surfaces 402*a*, 402*b*, 402*c*, and 402*n* when viewed in a flat configuration such as that seen in FIG. 4.

In one embodiment, width w of left-side column 412 of support surfaces 402*a*, 402*b*, 402*c*, and 402*n* and the width of right-side column 416 of support surfaces 402*a*, 402*b*, 402*c*, and 402*n* are equal. In one embodiment, a second column 414 of support surfaces is disposed between the first column 412 and third column 416 of support surfaces 402*a*, 402*b*, 402*c*, and 402*n*, and each individual support surface of second column 414 is disposed at a row position where spaces such as space 418, between support surfaces 402*a*, 402*b*, 402*c*, and 402*n* are present. In one embodiment, locations of spaces 418 on first side 404 of cartridge stabilization plate 400 are location of support surfaces, such as support surfaces 420*a*, 420*b*, and 420*n*, on a second, or opposite side 406 of cartridge stabilization plate 400.

For example, consider Table 3 below, representing a layout configuration of cartridge stabilization plate 400 of FIG. 4:

TABLE 3

| Top side left-most Column | Center Column | Right-most Column | Opposite Side left-most Column | Center Column | Right-most Column |
|---|---|---|---|---|---|
| half-support surface | space | support surface | space | support surface | space |
| space | support surface | space | support surface | space | support surface |
| support surface | space | support surface | space | support surface | space |
| space | support surface | space | support surface | space | support surface |
| support surface | space | support surface | space | support surface | space |
| space | support surface | space | support surface | space | support surface |
| support surface | space | support surface | space | support surface | space |
| space | support surface | space | support surface | space | support surface |
| support surface | space | support surface | space | support surface | space |

As can be seen from table 4, the right-most column of top side 404 is the opposite side of, and thus maps to the left-most column of opposite side 406. Correspondingly, the left-most column of top side 404 is the opposite side of, and thus maps to the right-most column of opposite side 406. The center column of top side 404 is the opposite side of, and thus maps to the opposite side 406 center column.

In one embodiment, support surfaces 402*a*, 402*b*, 402*c*, and 402*n* are disposed in the left-most column 412 with spaces between them in the same column. Correspondingly, additional support surfaces in the third, or right-most column 416 of table 3 are disposed at positions within the column similar to where support surfaces 402*a*, 402*b*, 402*c*, and 402*n* were disposed in first, or left-most column 412.

Further, in a second, or center column 414, support surfaces are disposed next to spaces of the left-most column 412 and right-most column 416, and spaces of the center column 414 are positioned at locations between support surfaces of the left-most column 412 and right-most column 416, according to one embodiment.

In one embodiment, a length of support surfaces 402*a*, 402*b*, 402*c*, and 402*n* and a distance between each of support surfaces 402*a*, 402*b*, 402*c*, and 402*n* are equal. In one embodiment, the space 418 between two consecutive support surfaces 402*a*, 402*b*, 402*c*, and 402*n* is greater than a diameter of an ammunition cartridge that ammunition package 300 is designed to store.

In one embodiment, a number of rows of support surfaces 402*a*, 402*b*, 402*c*, and 402*n* of a given column varies depending on the overall size of ammunition package 300.

Like support surfaces of left-most column 412 of cartridge stabilization plate 400, the height of support surfaces of center column 414 and right-most column 416 of cartridge stabilization plate 400 is greater than one-half of the largest diameter of an ammunition cartridge ammunition package 300 is designed to store. In one embodiment, opposite sides of those support surfaces are concavely curved to configure those support surfaces to support the convex curvature of ammunition cartridges being stored within ammunition package 300. In one embodiment, curved opposite sides of those support surfaces and have a curvature having a radius equal to or greater than a radius of a brass shell component of an ammunition cartridge ammunition package 300 is designed to store.

In one embodiment, just like support surfaces 402*a*, 402*b*, 402*c*, and 402*n*, support surfaces of center column 414 and the right-most column 416 of cartridge stabilization plate 400 have widths and lengths, both measured at a base of those respective support surfaces where those support surfaces extrude from the bottom surface of cartridge stabilization plate 400. In one embodiment, with respect to the right-most column 416 of cartridge stabilization plate 400, a width W of each support surface of the right-most column is greater than a length L of the support surface when viewed in a flat configuration such as that seen in FIG. 4. In one embodiment, with respect to the center column 414 of cartridge stabilization plate 400, a width W of each support surface is less than or equal to a length L of the same support surface when viewed in a flat, or open configuration such as that seen in FIG. 4.

In one embodiment, width W of left-side column 412 of support surfaces 402*a*, 402*b*, 402*c*, and 402*n* and the width W of right-side column 128 of support surfaces 402*a*, 402*b*, 402*c*, and 402*n* are equal within a predetermined tolerance. In one embodiment, the predetermined tolerance is 10% or less. In one embodiment, a second column of support surfaces, is disposed between the first column 412 and third column 416 of support surfaces 402*a*, 402*b*, 402*c*, and 402*n*, and each individual support surface of column 412 is disposed at a row position where spaces, such as space 418, between support surfaces 402*a*, 402*b*, 402*c*, and 402*n* are present. In one embodiment, distances between support surfaces, such as support surfaces 402*a*, 402*b*, 402*c*, and 402*n* is dependent on the caliber, and therefore the diameter, of ammunition cartridges ammunition package 300 is designed to store.

Further, the combination of left column 412, center column 414, and right column 416 are shifted from center, e.g. one edge has a greater distance from the edge of cartridge stabilization plate 400 and the beginning of a support surface than the other edge does. For example, a distance D is greater than a distance d, or a distance d is greater than a distance D. This allows for the optional further security when using ammunition package 300 with rimmed ammunition cartridges.

Figure 5:
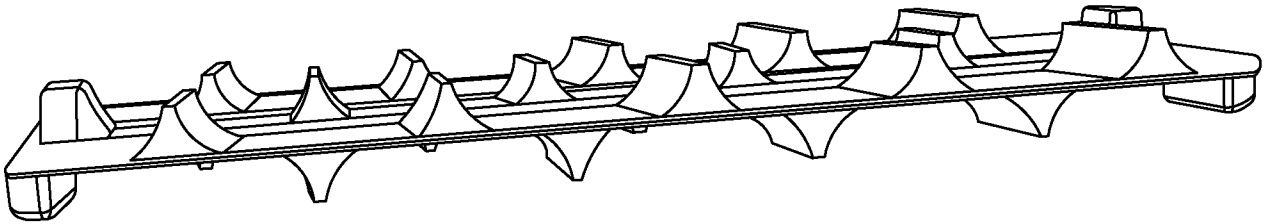
FIG. 5 is an isometric view of a cartridge stabilization plate according to one embodiment.

FIG. 5 is provided as a view to show the relationship of support surfaces and the opposite side spaces, among other things.

The present invention has been described in particular detail with respect to specific possible embodiments. Those of skill in the art will appreciate that the invention may be practiced in other embodiments or combinations of embodiments discussed herein. Also, particular divisions of functionality between the various components described herein, are merely exemplary, and not mandatory or significant. Consequently, functions performed by a single component may, in other embodiments, be performed by multiple components, and functions performed by multiple components may, in other embodiments, be performed by a single component.

It should also be noted that the language used in the specification has been principally selected for readability, clarity, and instructional purposes, and may not have been selected to delineate or circumscribe the inventive subject matter. Accordingly, the disclosure of the present invention is intended to be illustrative, but not limiting, of the scope of the invention, which is set forth in the claims below.

In addition, the operations shown in the figures are identified using a particular nomenclature for ease of description and understanding, but other nomenclature is often used in the art to identify equivalent structures.

Numerous variations, whether explicitly provided for by the specification or implied by the specification or not, may be implemented by one of skill in the art in view of this disclosure.

What is claimed is:

1. An ammunition package comprising:

a tri-fold container formed of a single piece, the container including right-side panel, a left-side panel and a center panel, the right-side panel and the left-side panels being hingedly attached to opposite sides of the center panel and configured so that when the ammunition package is in an open configuration the left-side panel has a top side and a bottom side, and the right-side panel has a top side and a bottom side, and in a closed configuration the top side of the left side panel faces towards a base of the center panel and the top side of the right side panel also faces towards the base of the center panel, the tri-fold container configured to store ammunition cartridges horizontally oriented, the center panel having a bottom and a side panel, the center panel bottom including a plurality of support surfaces arranged in columns and extending from the center panel bottom, each of the plurality of support surfaces having a height greater than a predetermined radius, each support surface further including opposite sides concavely curved in the radius, a first column having support surfaces arranged in alternating fashion, alternating between support surface and space between a topmost position and a bottommost position of the first column;

the right panel having a bottom and a side panel, the right panel bottom including a plurality of support surfaces arranged in columns and extending from a base of the center panel, each of the plurality of support surfaces having a height greater than the radius, each support surface further including opposite sides concavely curved in the radius, a first column having support surfaces arranged in alternating fashion, alternating between support surface and space between a topmost position and a bottommost position of the first column, wherein when the right panel is folded on a hinge line between the left panel and the center panel, support surfaces of the right panel are offset with support surfaces of the center panel.

2. The ammunition package of claim 1 further comprising wherein the ammunition package is rectangular and therefore has a right side, a left side, a top side and a bottom side, where the right side and the left side are each longer than the top side and the bottom side.

3. The ammunition package of claim 1 wherein, when the ammunition package is in a closed configuration, the right panel is folded into a position fitting with the center panel and the left panel is then folded into a position fitting with the right panel.

4. The ammunition package of claim 1 wherein when the ammunition package is in a closed configuration, a cutout portion of an edge of the center panel maps to a roughened portion of an edge of the right panel to assist in converting the closed configuration to an open configuration.

5. The ammunition package of claim 1 wherein an outside surface of the bottom of the center panel of a first ammunition package includes two or more extrusions configured to map into a top surface of a second ammunition package formed into a stacked configuration with the first ammunition package.

6. The ammunition package of claim 1 wherein the top side of the right-side panel includes one or more extrusions projecting from a base of the top side into the interior of the ammunition package when the ammunition package is in a closed configuration, the extrusions configured to stabilize one or more ammunition rounds stored within the ammunition package.

* * * * *